US006733154B1

(12) United States Patent
Dahlen

(10) Patent No.: US 6,733,154 B1
(45) **Date of Patent: *May 11, 2004**

(54) INDIRECT LUMINAIRE

(75) Inventor: Kevin S. Dahlen, Fontana, CA (US)

(73) Assignee: Genlyte Thomas Group LLC, Louisville, KY (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/160,225

(22) Filed: May 31, 2002

(51) Int. Cl.[7] ..... F21V 7/00; F21S 3/00

(52) U.S. Cl. ..... 362/217; 362/298; 362/346; 362/301

(58) Field of Search ..... 362/217, 297, 362/298, 346, 301, 304, 225, 147, 223, 300

(56) References Cited

U.S. PATENT DOCUMENTS

| | | | | |
|---|---|---|---|---|
| 2,990,470 A | | 6/1961 | Bodian et al. | |
| 4,065,667 A | * | 12/1977 | Ruud et al. | 362/217 |
| 4,388,675 A | | 6/1983 | Lewin | |
| 4,866,584 A | | 9/1989 | Plewman | |
| 4,939,627 A | | 7/1990 | Herst et al. | |
| 5,371,661 A | | 12/1994 | Simpson | |
| 5,440,466 A | | 8/1995 | Belisle et al. | |
| 5,570,947 A | | 11/1996 | Felland | |
| 5,658,066 A | | 8/1997 | Hirsch | |
| 5,865,528 A | | 2/1999 | Compton et al. | |
| 5,884,994 A | | 3/1999 | Herst et al. | |
| 6,186,642 B1 | | 2/2001 | Corcorran et al. | |
| 6,193,394 B1 | | 2/2001 | Herst et al. | |
| 6,247,828 B1 | | 6/2001 | Herst | |
| 6,305,816 B1 | | 10/2001 | Corcorran et al. | |
| 6,505,953 B1 | * | 1/2003 | Dahlen | 362/217 |

* cited by examiner

*Primary Examiner*—Thomas M. Sember
(74) *Attorney, Agent, or Firm*—Middleton Reutlinger

(57) ABSTRACT

A suspended indirect linear fluorescent luminaire utilizing a parabolic reflector assembly and kick reflector members in conjunction with large luminous lenses as viewed from below. The kick reflector members are suspended from the upper section inner edges of each lens member. The parabolic reflector assembly is positioned under the linear fluorescent lamp to redirect a portion of the light emitted from the underside of the lamp toward the kick reflector members and toward the area of the lens members behind the kick reflector members. Thus, the lens members may be evenly illuminated without a shadow from the kick reflector member, and the optical system of the luminaire may provide a wide light distribution so that the luminaire may have short suspension distances.

11 Claims, 4 Drawing Sheets

INDIRECT LUMINAIRE

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND OF THE INVENTION

1. Field of the Invention

The present invention relates to suspended luminaires designed to use linear fluorescent lamps to provide general lighting by illuminating the ceiling, and also provide a large luminous lens when viewed from below.

2. Background Art

With the recent proliferation of Video Display Terminals (VDTs) in the office environment, lighting designers have identified high contrast overhead lighting as a source of glare and reflection on VDT screens. Such glare and reflection is an undesirable effect which impacts worker comfort and productivity. Thus, the need has arisen for efficient low contrast illumination of the work environment.

Indirect linear fluorescent overhead lighting has been determined to be the most efficient means of illuminating a large office environment while providing low contrast illumination of the work area. Such lighting is accomplished by positioning linear fluorescent fixtures below the plane of the ceiling and directing light upward toward the ceiling. The light is then reflected off of the ceiling downward toward the room. Uniform illumination of the ceiling will provide low contrast lighting. Reflectors are used to produce wide distributions and permit short suspension distances.

Additionally, designers have found that eliminating glare does not in itself result in a pleasant environment. An appropriate perceived brightness has been found to be necessary to create comfort and a sense of well-being. Thus, lighting designers desire indirect luminaires having large luminous lens areas. Such large luminous lens areas are said to give the luminaire a 'chandelier' look.

A problem with prior art lumianires is that even illumination of large luminous lens areas has precluded the use of optical control elements, such as outboard kick reflectors, which may create shadows on the lens areas. Thus, the performance of the indirect component of such fixtures has suffered to provide the aesthetic benefit of the large luminous lens areas.

BRIEF SUMMARY OF THE INVENTION

It is an object of the present invention to provide a suspended indirect linear fluorescent luminaire with a large luminous lens area having a wide optical distribution for a short suspension distance.

It is a further object of the present invention to provide a suspended indirect linear fluorescent luminaire having even illumination of large luminous lens areas and utilizing outboard kick reflectors, which does not have kick reflector shadows on the lens areas.

It is yet a further object of the present invention to provide a suspended indirect linear fluorescent luminaire having even illumination of large luminous lens areas and utilizing outboard kick reflectors which utilizes a parabolic reflector assembly under the tubular lamp to focus light toward the kick reflectors and toward the lens areas behind the kick reflectors.

These and other objects are achieved through the use of a suspended indirect linear fluorescent luminaire having a linear fluorescent lamp defining a central longitudinal axis for the optical system of the luminaire, or at least lamp sockets for such a lamp. The luminaire further has a parabolic reflector assembly having a pair of elongated reflectors, with each reflector having a substantially parabolic shaped cross section and being joined to form an apex parallel to and directly under the longitudinal axis of the lamp. The luminaire still further has a pair of lens members which are symmetrically arranged on either side of the longitudinal axis, with each lens member having an upper section inner portion longitudinal edge. Further still, the luminaire utilizes a pair of elongated kick reflector members, with each kick reflector member being supported along a different one of the lens member upper section inner portion longitudinal edges such that each of the substantially parabolic shaped reflectors redirects a portion of the light emitted by the underside of the linear fluorescent lamp toward the corresponding kick reflector member and toward the corresponding lens member upper section. Thus, the lenses may be illuminated in the shadow area behind the kick reflector members, and also have a wide optical distribution for a short suspension distance from the ceiling.

DETAILED DESCRIPTION OF THE INVENTION

Figure 1:
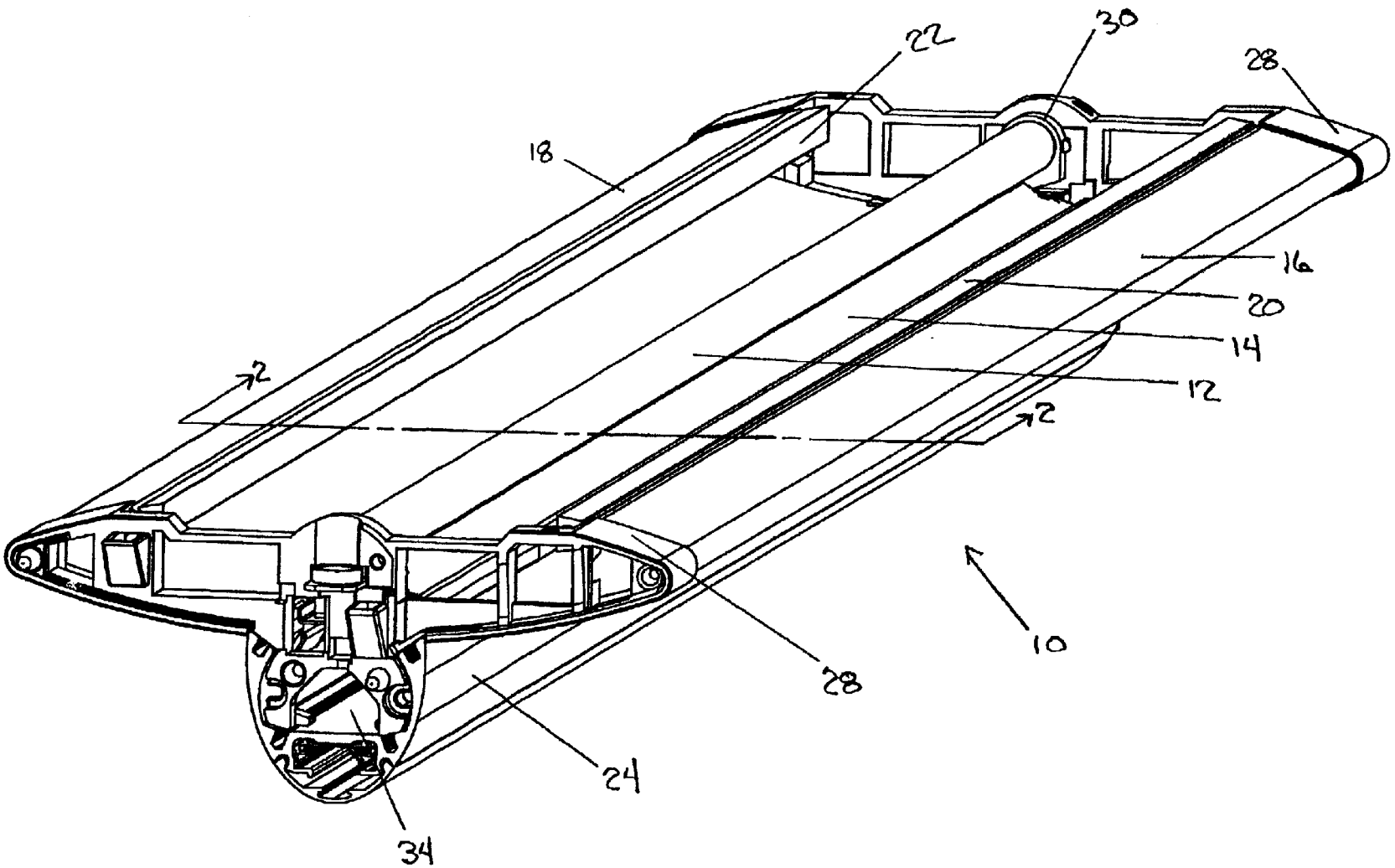
FIG. 1 shows a perspective view of an indirect luminaire of a preferred embodiment of the present invention.
Figure 2:
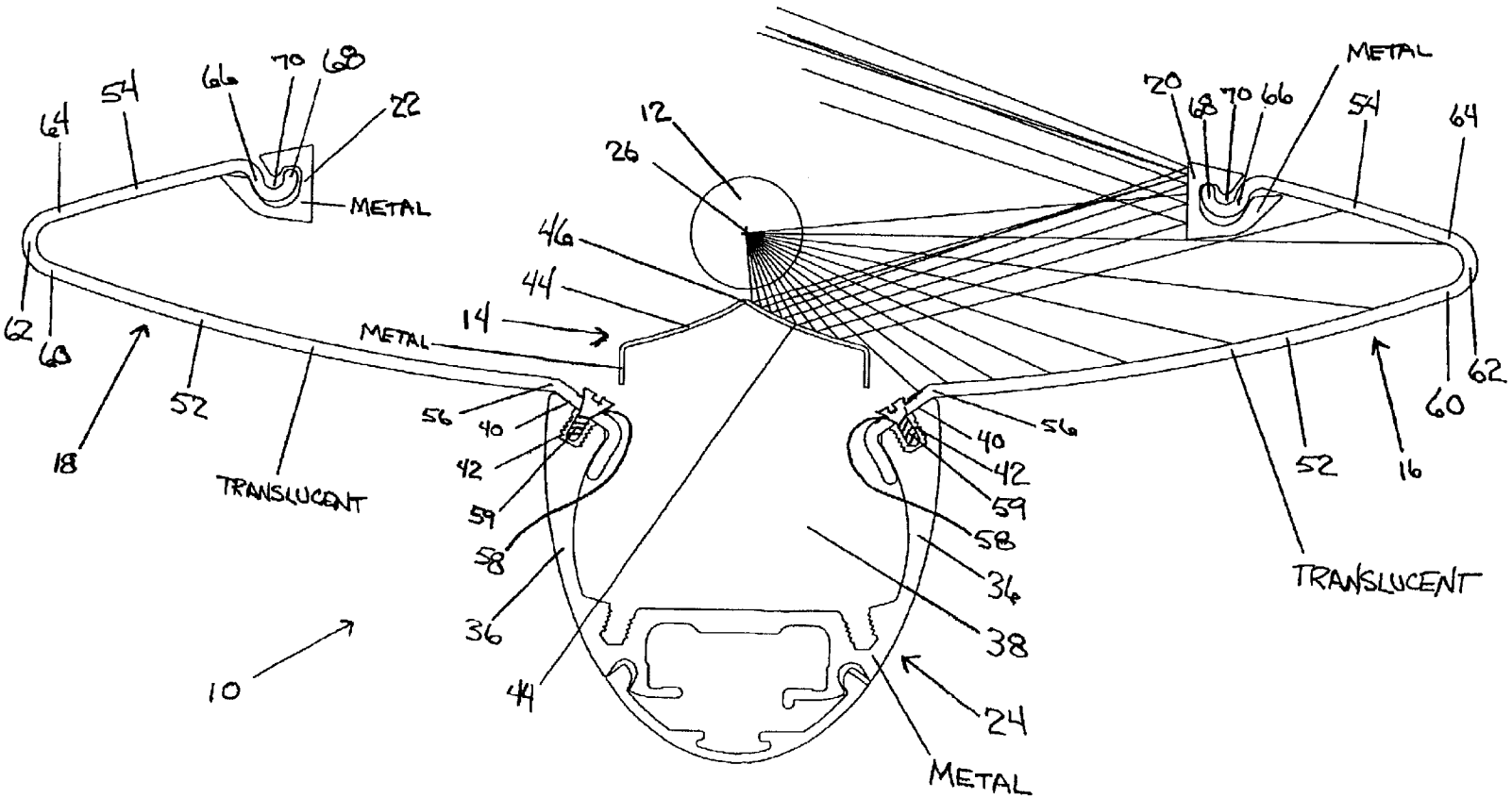
FIG. 2 shows a sectional view of the components of the optical system only, taken along line 2—2 of FIG. 1, with ray trace indications thereon.

As shown in FIGS. 1 and 2, the indirect luminaire 10 of the preferred embodiment of the invention comprises a tubular lamp 12, a parabolic reflector assembly 14, a first lens member 16, a second lens member 18, a first kick reflector member 20, a second kick reflector member 22, and a housing member 24.

The tubular lamp may be a T5 high output type fluorescent lamp, but one skilled in the art will recognize that the benefits of the optical system of the invention will be realized with any tubular lamp. The center of the tubular lamp 12 defines a longitudinal or optical axis 26 about which the optical system of the invention is based. Further, as shown, the luminaire 10 and its elements have an elongated shape which is symmetric about the longitudinal axis 26 of the tubular lamp 12. Thus, the principals of the invention are independent of the length of the lamp and luminaire 10, although the preferred embodiment utilizes a 48 inch tube length.

Bracket members 28 connect the parabolic reflector assembly 14, lens members 16, 18, kick reflector members 20,22, and housing member 24 of the luminaire together at each end of the luminaire. Appropriate lamp sockets 30 for the tubular lamp 12 are attached to and supported by each bracket member 28. The lamp sockets 30 may also be used to define the location of the optical axis 26 of the luminaire, since the luminaire may be sold with or without the tubular lamp 12.

Figure 3:
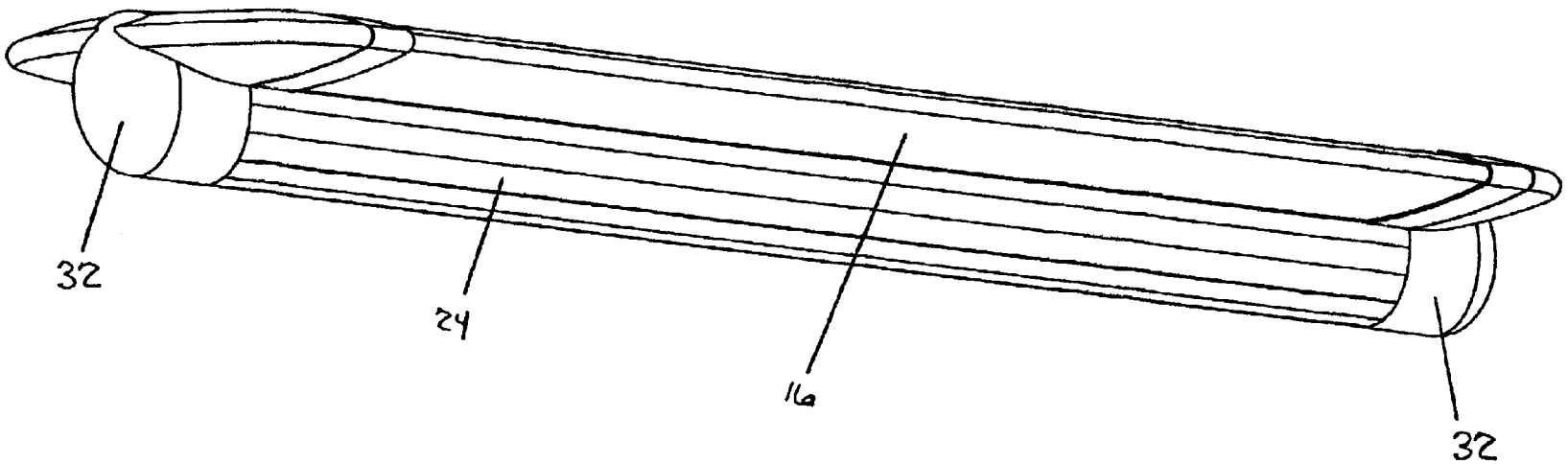
FIG. 3 shows a perspective view of the indirect luminaire of FIG. 1, further having decorative end caps installed thereon.

Additionally, as shown in FIG. 3, a fully assembled luminaire 10 may have a decorative end cap 32 located at one or both ends, or may be joined together with other luminaires to form an uninterrupted row of luminaires. Thus, the bracket members 28 of adjoining fixtures are configured to mate together and have wiring passages 34 to allow wiring to pass between the housings of each luminaire, as shown in FIG. 1.

Returning to FIG. 2, the housing member 24 is trough shaped and has side walls 36 which form an open interior area 38 where electrical components such as ballasts, transformers and wiring may reside. The housing member 24 is located under the tubular lamp 12 and the parabolic reflector assembly 14. Additionally, the upper longitudinal edges 40 of the housing member 24 each contain threaded grooves 42 which run the length of the upper longitudinal edges 40.

In the preferred embodiment, the housing member 24 is an extruded aluminum material.

The parabolic reflector assembly 14 is located directly beneath the tubular lamp 12 and has a pair of elongated reflectors 44, with each reflector 44 having a substantially parabolic shaped cross section. For this description, these reflectors will be referred to as parabolic reflectors 44. However, one of skill in the art will recognize that, for ease of manufacturing, designs incorporating parabolic shaped reflectors often utilize two or more arc shaped reflector segments joined to substantially approximate the desired parabolic shape.

The parabolic reflectors 44 are joined to form an elongated apex 46 parallel to and directly under the longitudinal axis 46 of the tubular lamp 12.

In the preferred embodiment, the parabolic reflector assembly 14 has a unitary construction, being fabricated from aluminum and having a semi-specular reflective finish.

The lens members 16, 18 are also elongated and are located on either side of the tubular lamp 12, extending outward in a wing-like fashion. Thus, each lens member 16,18 has a lower section 52 and an upper section 54.

The lower section 52 of each lens member 16, 18 has an interior portion 56 which has a plurality of screw holes 58. Each lens member 16, 18 is attached along the corresponding housing member upper longitudinal edge 40 with screws 59 in cooperation with the lens member screw holes 58 and the housing member threaded grooves 42. As shown, the inner portion 56 may also bend around the housing member upper longitudinal edge 40 and along the interior side of the housing member side wall 36 for additional support and stability.

The lower section 52 of each lens member 16, 18 then extends outward, or upward and outward, from the housing 24 to an outer portion 60. The lower section outer portion 60 then curves around to meet an outer portion 64 of the upper section of the lens, forming a curved, nose-like transition from the lower section outer portion 60 to the upper section outer portion 64 at the outer perimeter 62, or outboard, of the luminaire 10.

The upper section 54 of each lens member then extends inward and upward to an inner portion 66 which terminates along a longitudinal edge 68 which is parallel to, horizontally spaced from, and located above a horizontal plane through the longitudinal axis 26 of the tubular lamp. Thus, the top of the luminaire is open. Further, the inner portion longitudinal edge 68 of each lens member 16, 18 is positioned vertically higher than the longitudinal axis 26 of the tubular lamp. An upwardly open longitudinal channel 70 or groove is formed in the upper section adjacent to the inner portion longitudinal edge 68.

In the preferred embodiment, the lens members 16, 18 are made of an extruded acrylic translucent material and serve as a luminous diffusers. The lens members are textured for increased performance. Each lens member is of unitary construction. However, one of skill in the art will recognize that the teachings of this invention may utilized with other materials having alternate properties, constructions and configurations.

The kick reflector members 20, 22 each have elongated substantially C-shaped bodies.

Figure 4:
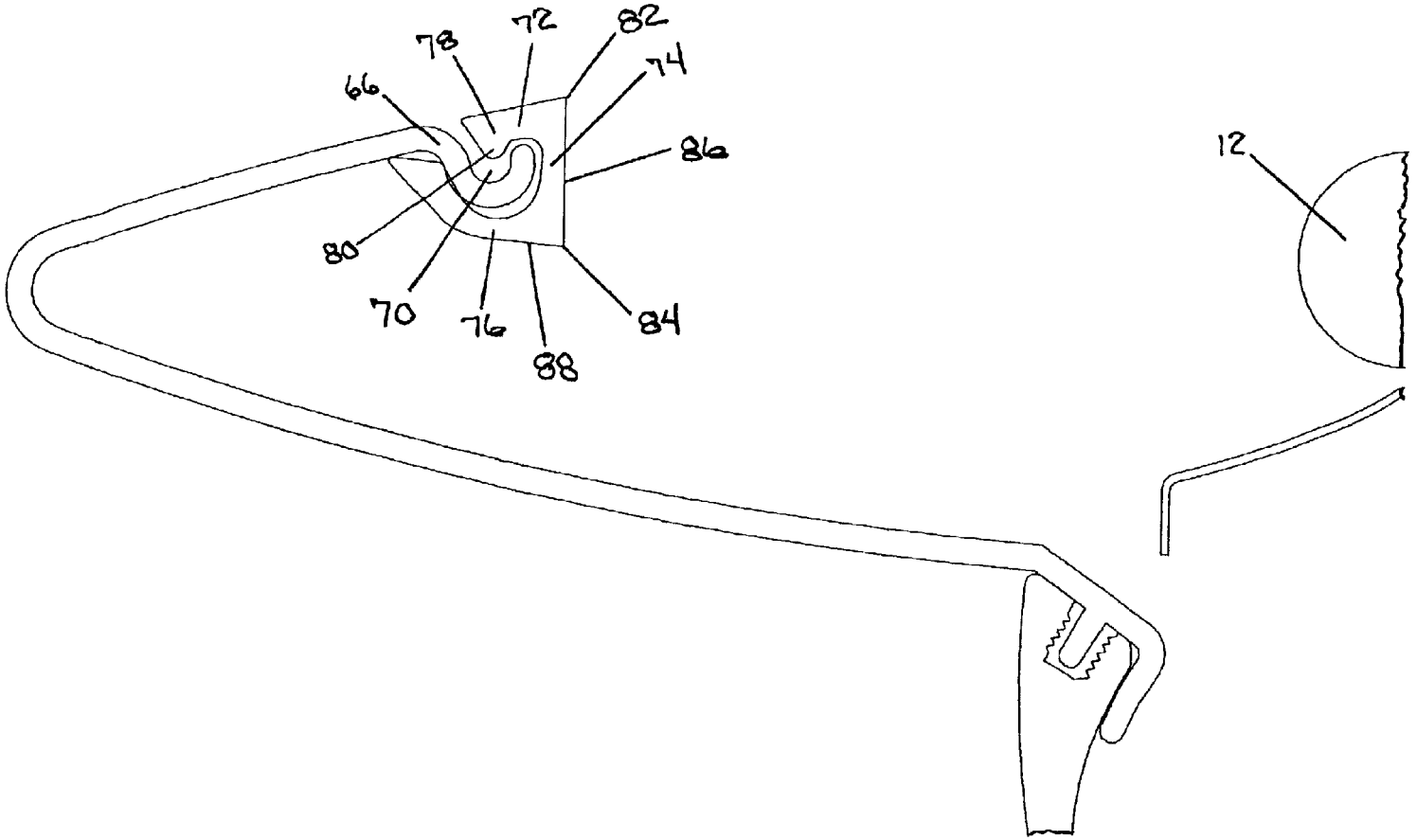
FIG. 4 shows an enlargement of a portion of FIG. 2.

FIG. 4 shows an enlargement of one side of the luminaire of FIG. 2, it being understood, for the purposes of this description, that the other side of the luminaire is a mirror image of the shown side, and that the following discussion shall apply to both sides of the luminaire. Thus, each kick reflector member has an upper wall 72, a side wall 74, and a bottom wall 76.

The top wall 72 has an outer end portion 78 having a downwardly directed ridge 80 or detent that runs along the length of the kick reflector member.

The side wall 74 has a top edge 82, a bottom edge 84, and an outer surface 86. The outer surface 86 is substantially vertical and has a reflective finish. However, other orientations could be utilized to achieve different results without departing from the spirit or scope of the claimed invention.

Thus, each kick reflector member 20, 22 may hang from the upper section inner portion 66 of a lens member such that the kick reflector member ridge 80 engages the lens member channel 70 and the reflective outer surface 86 of the kick reflector member faces the tubular lamp 12.

Further, the kick reflector member bottom wall 76 may be shaped to cooperate with the upper section inner portion 66 of the lens member for additional stability, and, may also have an outer lower surface 88 having a reflective finish.

The side wall top edge 82 of each kick reflector member is positioned vertically higher than and horizontally spaced from the top edge of the tubular lamp 12.

Likewise, the side wall member bottom edge 84 of each kick reflector member is positioned vertically higher than and horizontally spaced from the longitudinal axis 26 of the lamp.

In the preferred embodiment, the kick reflector members are formed of an extruded aluminum material having a highly polished reflective finish on at least the side wall outer surface 86 and the bottom wall outer lower surface 88.

Thus, as shown in FIG. 2, the described configuration of the elements creates a optical system for a indirect linear fluorescent suspended luminaire with a large luminous lens when viewed from below. Each parabolic reflector 44 redirects light from the underside of the lamp 12 which would be otherwise directed to the area over the housing member 24, and substantially concentrates that light on the corresponding kick reflector reflective side wall 74. Each kick reflector reflective side wall 74 then redirects that light out of the luminaire 10 at relatively low angles to produce a wide light distribution and permit a short suspension distance of the luminaire from the ceiling. Additionally, the parabolic reflector assembly 14 directs a small amount of light below the bottom edge 84 of each kick reflector side wall to illuminate the lens member upper section 54 in the area behind the kick reflector member 20, 22. Still further, any light striking the reflective bottom wall outer lower surfaces 88 of the kick reflector members 20, 22 will also be efficiently reflected to the lens member upper section and lower section outer portions 60, 64. Thus, the parabolic reflector assembly 14 also serves to provide additional illumination to the shadow area created by the kick reflector members 20, 22 on each lens member and to the lend member upper section and lower section outer portions 60, 64, to create an even illumination of the lens members 16, 18.

It is important to note that, while FIG. 2 shows light emanating from the axis of the lamp, in actuality the light from a fluorescent lamp radiates from the surface of the tubular lamp. Further, the rays shown in FIG. 2 are spaced in b 6degree increments for convenience, but in reality the rays emanate continuously from the entire surface of the lamp, of course. Thus, the parabolic reflectors 44 will operate on the entire lamp image which is visible thereto, causing illumination from the lamp image to spill over the kick reflector side wall top edges 82 and under the kick reflector side wall bottom edges to a greater extent than indicated by the approximation shown. This spill light further enhances the wide light distribution and even lens illumination characteristics of the indirect luminaire of the invention.

In the preferred embodiment shown in FIG. 2, the parabolic reflectors 44 extend to about 45 degrees from each side of nadir below the lamp 12. This configuration allows direct illumination of the lens members 16, 18 from the junction between the lens member lower sections 52 and the housing member upper longitudinal edges 40 to the nose-like transition area between the outer portions 60, 64 of the lens member lower 52 and upper sections 54. Additionally, additional illumination of the lens members 16, 18 is provided by reflection from the lower portion of the parabolic reflectors 44. Thus, the lens members 16, 18 may be evenly illuminated, while the lamp 12, parabolic reflector assembly 14, and kick reflector members 20, 22 cooperation to provide a wide light distribution and, thus, a short suspension distance.

The detail description of the preferred embodiment contained hereinabove shall not be construed as a limitation of the following claims, as it will be readily apparent to those skilled in the art that design choices may be made changing the materials, construction, or configuration of the luminaire without departing from the spirit or scope of the claimed invention.

What is claimed is:

1. A suspended indirect linear fluorescent luminaire comprising:

first and second opposing lamp sockets for a linear fluorescent lamp, said lamp sockets defining a central longitudinal axis for the optical system of the luminaire;

a parabolic reflector assembly having:

a pair of elongated reflectors, each reflector having a substantially parabolic shaped cross section, said substantially parabolic shaped reflectors being joined to form an elongated apex, said parabolic reflector assembly being positioned such that said apex is parallel to and directly under said longitudinal axis;

first and second elongated lens members being symmetrically arranged on either side of said longitudinal axis, each lens member having an upper section, each of said upper sections having an inner portion, each of said upper section inner portions terminating at a longitudinal edge; and first and second elongated kick reflector members, each kick reflector member having a side wall, said side wall having an outer surface, said side wall outer surface having a reflective finish, each said kick reflector member supported along a different one of said elongated lens member upper section inner portion longitudinal edges.

2. The suspended indirect linear fluorescent luminaire of claim 1 further comprising a trough-shaped housing member positioned under said parabolic reflector assembly, said housing member having side walls, said side walls having upper longitudinal edges.

3. The suspended indirect linear fluorescent luminaire of claim 2, wherein each of said lens member upper sections further has an outer portion and wherein each of said first and second elongated lens members further has a lower section having an inner portion and an outer portion, each lens lower section inner portion attached along a different one of said housing member upper longitudinal edges and extending outward therefrom, each lens lower section outer portion attached at the corresponding lens upper section outer portion, each lens upper section extending inward and upward therefrom.

4. The suspended indirect linear fluorescent luminaire of claim 3, wherein each of said upper section inner portion longitudinal edges is parallel to, horizontally spaced from, and vertically higher than said longitudinal axis.

5. The suspended indirect linear fluorescent luminaire of claim 4, wherein each of said kick reflector member side walls further has a bottom edge, each of said kick reflector side wall bottom edges being parallel to, horizontally spaced from, and vertically higher than said longitudinal axis.

6. The suspended indirect linear fluorescent luminaire of claim 5, wherein each of said kick reflector member side walls further has a top edge, said kick reflector member side wall top edges being horizontally spaced from and vertically higher than the top of said tubular lamp.

7. The suspended indirect linear fluorescent luminaire of claim 6, wherein each of said lens member upper section inner portions further has an upwardly open longitudinal channel formed adjacent to said lens member upper section inner portion longitudinal edge, wherein each of said kick reflector members has a substantially C-shaped body further having an upper wall extending from said side wall, each of said kick reflector upper walls having an outer end portion having a downwardly directed ridge, each of said lens member upwardly open longitudinal channels cooperating with the corresponding kick reflector downwardly directed ridge in supporting relation.

8. A suspended indirect linear fluorescent luminaire comprising:

first and second opposing lamp sockets for a linear fluorescent lamp, said lamp sockets defining a central longitudinal axis for the optical system of the luminaire;

a parabolic reflector assembly having:

a pair of elongated reflectors, each reflector having a substantially parabolic shaped cross section, said substantially parabolic shaped reflectors being joined to form an elongated apex, said parabolic reflector assembly being positioned such that said apex is parallel to and directly under said longitudinal axis;

a trough-shaped housing member positioned under said parabolic reflector assembly, said housing member having side walls, said side walls having upper longitudinal edges;

first and second elongated lens members being symmetrically arranged on either side of said longitudinal axis, each lens member having a lower section and an upper section, each of said upper and lower sections having an inner portion and an outer portion, said inner portions being proximate to said longitudinal axis, said upper section inner portion terminating at a longitudinal edge, each said upper section inner portion longitudinal edge being parallel to, horizontally spaced from, and vertically higher than said longitudinal axis, each lens lower section inner portion attached along a different one of said housing member upper longitudinal edges and extending outward therefrom, each lens lower section outer portion attached at the corresponding lens upper section outer portion, each lens upper section extending inward and upward therefrom;

first and second elongated kick reflector members, each kick reflector member having a side wall, said side wall having a bottom edge and an outer surface, said side wall outer surface having a reflective finish, each said kick reflector member supported along a different one of said elongated lens member upper section inner portion longitudinal edges, each of said kick reflector side wall bottom edges being parallel to, horizontally spaced from, and vertically higher than said longitudinal axis; and first and second bracket members located at each end of said luminaire, each of said bracket members connecting said lamp sockets, said parabolic reflector assembly, said housing member and said first and second lens members together at each end of said luminaire.

9. The suspended indirect linear fluorescent luminaire of claim 8, wherein each of said kick reflector member side walls further has a top edge, said kick reflector member side wall top edges being horizontally spaced from and vertically higher than the top of said tubular lamp.

10. The suspended indirect linear fluorescent luminaire of claim 9, wherein each of said lens member upper section inner portions further has an upwardly open longitudinal channel formed adjacent to said lens member upper section inner portion longitudinal edges, wherein each of said kick reflector members has a substantially C-shaped body further having an upper wall extending from said side wall, each of said kick reflector upper walls having an outer end portion having a downwardly directed ridge, each of said lens member upwardly open longitudinal channels cooperating with the corresponding kick reflector downwardly directed ridge in supporting relation.

11. A suspended indirect linear fluorescent luminaire comprising:

a linear fluorescent lamp, said lamp defining a central longitudinal axis for the optical system of the luminaire;

a parabolic reflector assembly having:

a pair of elongated reflectors, each reflector having a substantially parabolic shaped cross section, said substantially parabolic shaped reflectors being joined to form an elongated apex, said parabolic reflector assembly being positioned such that said apex is parallel to and directly under said longitudinal axis;

first and second elongated lens members being symmetrically arranged on either side of said longitudinal axis, each lens member having an upper section, each of said upper sections having an inner portion, each of said upper section inner portions terminating at a longitudinal edge;

first and second elongated kick reflector members, each kick reflector member having a side wall, said side wall having an outer surface, said side wall outer surface having a reflective finish, each said kick reflector member supported along a different one of said elongated lens member upper section inner portion longitudinal edges such that each of said substantially parabolic shaped reflectors redirects a portion of the light emitted by the underside of said linear fluorescent lamp toward the corresponding kick reflector member and toward the corresponding lens member upper section.

* * * * *